United States Patent [19]

Callahan et al.

[11] Patent Number: 4,854,479

[45] Date of Patent: Aug. 8, 1989

[54] ADJUSTABLE CUP DISPENSING ASSEMBLY

[75] Inventors: David T. Callahan; Barry A. Moorefield, both of Lynchburg, Va.

[73] Assignee: Allen-Morrison, Inc., Lynchburg, Va.

[21] Appl. No.: 232,685

[22] Filed: Aug. 16, 1988

[51] Int. Cl.[4] ..... A47F 1/08

[52] U.S. Cl. ..... 221/304; 221/310; 221/241; 221/279

[58] Field of Search ..... 221/304, 303, 307, 308, 221/310, 241, 279, 44, 56, 59, 63; 312/43, 71

[56] References Cited

U.S. PATENT DOCUMENTS

| | | | |
|---|---|---|---|
| 1,318,317 | 10/1919 | Elsas | 221/307 X |
| 2,150,306 | 3/1939 | Wessman | 221/308 X |
| 2,315,827 | 4/1943 | Tansley | 221/304 |
| 3,071,292 | 1/1963 | Atwood et al. | 221/241 X |
| 3,426,941 | 2/1969 | Hovekamp | 221/241 X |
| 3,581,934 | 6/1971 | Sciascia | 221/304 |
| 3,790,023 | 2/1974 | Filipowicz | 221/304 |
| 4,126,248 | 11/1978 | House | 221/241 |
| 4,234,101 | 11/1980 | Pastore | 221/241 |
| 4,243,153 | 1/1981 | Mitchell | 221/279 X |
| 4,261,480 | 4/1981 | Fuss | 221/304 |
| 4,298,142 | 11/1981 | Stanley | 221/304 |
| 4,319,696 | 3/1982 | Stevens | 221/310 |
| 4,426,017 | 1/1984 | Ficken et al. | 221/241 X |
| 4,658,983 | 4/1987 | Suttles | 221/44 |

*Primary Examiner*—Joseph J. Rolla
*Assistant Examiner*—David H. Bollinger
*Attorney, Agent, or Firm*—Mason, Fenwick & Lawrence

[57] ABSTRACT

A cup dispenser for dispensing a stacked array of cups comprising housing for enclosing a plurality of cups arranged in a stack, three parallel rods extending inwardly of the housing parallel to the axis of the stack of cups disposed in surrounding relation to the stack. A spring urged pusher guided by rods engaging the stack of cups at the end of the stack opposite a discharge opening for urging the stack of cups toward the discharge opening. An adjustable ring assembly is provided for releasably restraining cups of different size, comprising a first apertured ring or panel and a second ring rotatably supported relative to the first ring or panel and slots therein, coactive with pins extending from finger members for moving the finger members inwardly and outwardly relative to the stack.

16 Claims, 5 Drawing Sheets

ADJUSTABLE CUP DISPENSING ASSEMBLY

BACKGROUND AND OBJECTS OF THE INVENTION

The present invention relates in general to cup dispensing apparatus capable of dispensing cups of different diameter, and more particularly to an adjustable cup dispenser for dispensing paper cups and the like individually from a stack of cups.

Heretofore, numerous paper cup dispensers have been provided that are either wall mounted or counter mounted, and include structure for supporting a stack of cups in a vertical or horizontal disposition, such that cups may be individually withdrawn from an open end of the storage device. Usually the rim of the lower most or outermost cup in the stack is supported in some manner within the storage or housing device, and by pulling downwardly or outwardly on this exposed cup, the rim of the cup passes over restraint devices. When the stack of cups is arranged along a horizontal axis, as on a counter top or the like, a spring is usually provided to urge the stack of cups towards the withdrawal opening.

Most of such prior art dispensers are designed to dispense only a single size or diameter of cups. In such cases, if it is desired to change the cups size, it is also necessary to change the dispenser.

In conventional cup dispensers on the market having spring-urged cup stacks, travel of the pusher and spring for urging the stack cups toward the discharge opening is limited and confined in a tube which also serves to keep the cups in place. This tube tends to limit the effective size range of the assembly.

An object of the preset invention is the provision of a novel adjustable cup dispenser provided with a spring biased pusher urging the cup toward a discharge opening and a unique adjustable collar by which the cups are held in the dispenser for release one at a time, wherein adjustment for different sizes of cups can be made from inside the cabinet or outside the cabinet of the cup dispenser device. The design provides for extra strength and wide adjustment of ranges while maintaining desired point of contact without some other part of restraining fingers interfering with the cup dispensing action. Also, movement of the spring is confined by a rim on a pusher structure and travel of the pusher is confined by its travel on three guide rods, with the cups held in place by the pusher which centers the cups as a consequence of its special configuration and pressure from a spring urging the cups towards the discharge opening.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
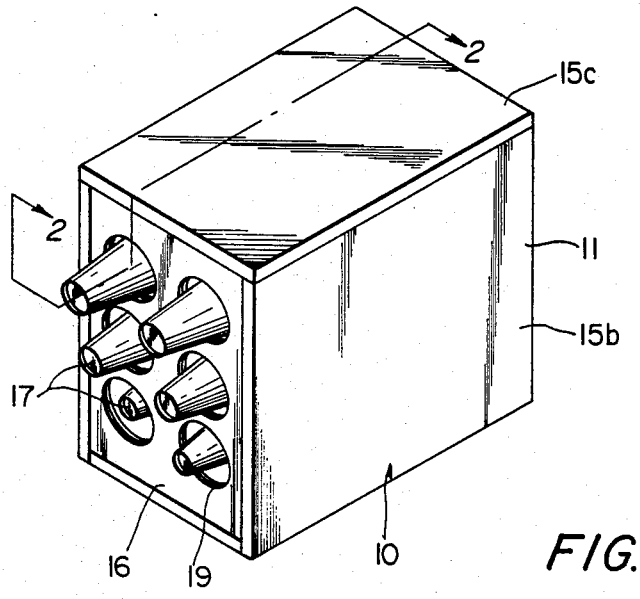
FIG. 1 is a perspective view of a cup dispenser embodying the present invention.

Referring to the drawings, wherein like reference characters designate corresponding parts throughout the several figures, there is illustrated an example of a countertop cup dispenser assembly indicated generally by the reference character 10, in the form of a rectangular housing 11 formed of opposite side panels **12*a*, 12*b*, a front support member 13, and a rear support member 14, secured together by fastening screws and covered by side cover panels 15*a*, 15*b*, top cover panel 15*c*, bottom panel 15*d*, and apertured front panel 16, assembled together and to the support framework formed by panels 12*a*, 12*b*, 13 and 14**, by conventional machine screws.

Figure 3:
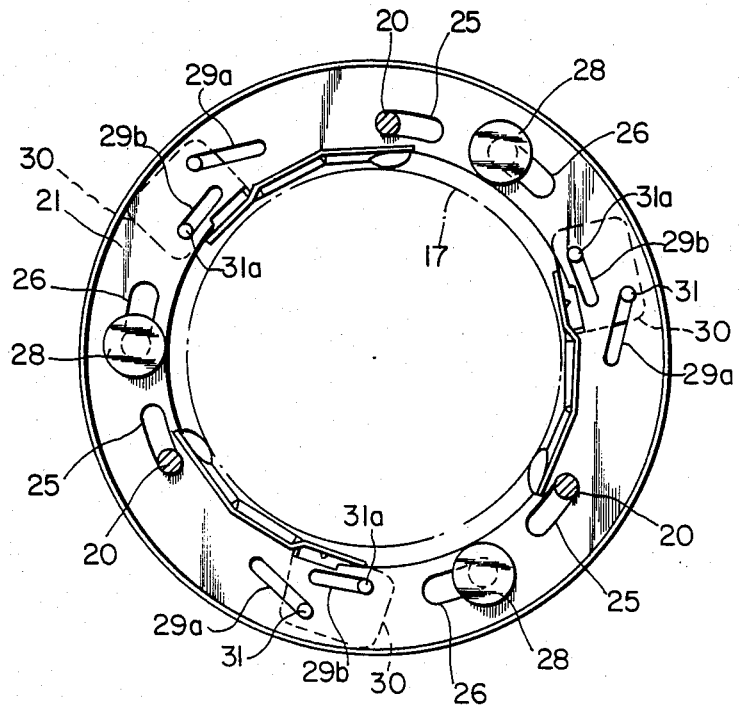
FIG. 3 is a fragmentary section view showing the collar assembly in maximum open position, taken along the line 3—3 of FIG. 2.
Figure 2:
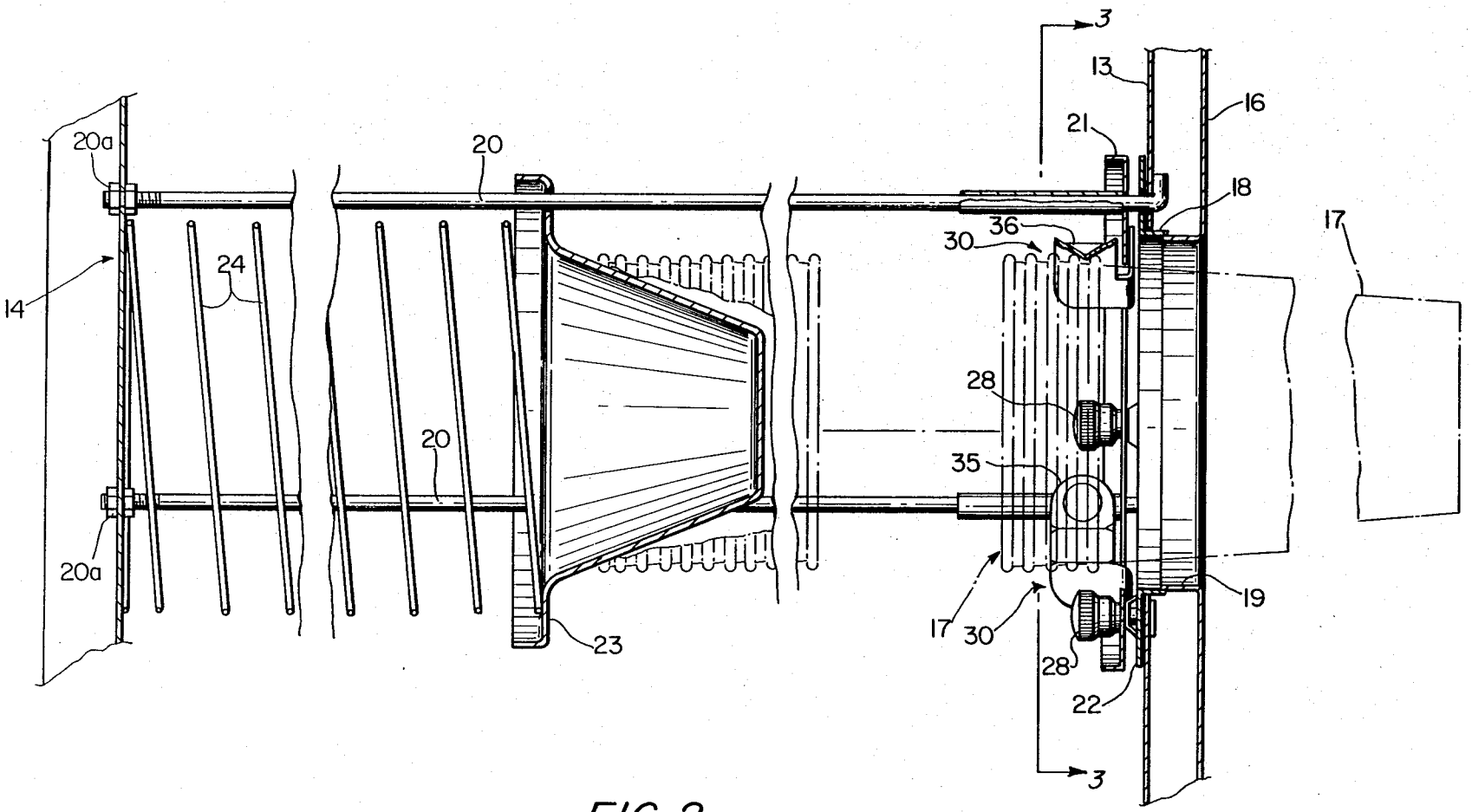
FIG. 2 is a detailed section view, to enlarge scale, taken along the line 2—2 of FIG. 1, showing the details of the cup dispenser structure and adjustable restraining collar and associated mechanism.
Figure 4:
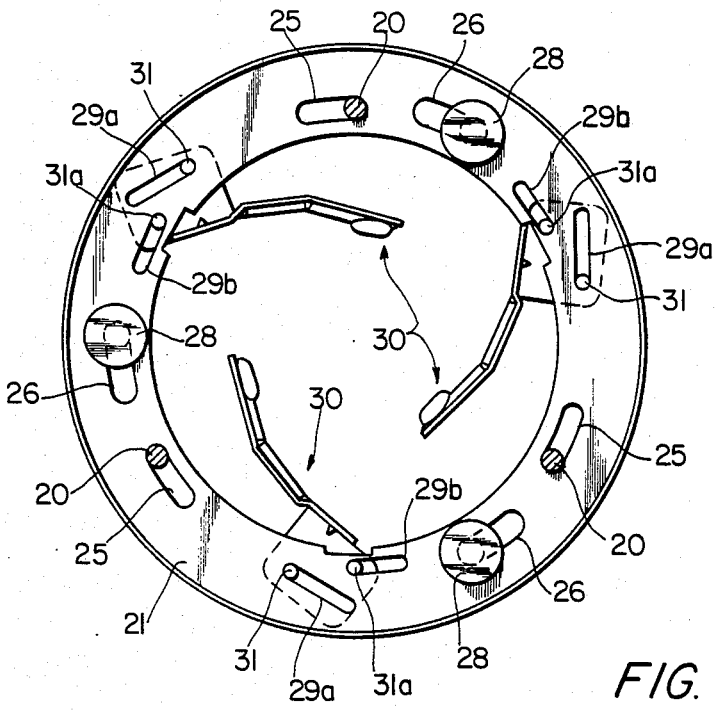
FIG. 4 is a fragmentary section view similar to FIG. 3, but showing the collar assembly in minimum open position.

The cups to be dispensed are maintained in a plurality of stacked arrays, indicated generally at 17, aligned axially with the circular openings 18 in the front support member 13 and the openings 19 in the front cover panel 16. At each cup supply station, three elongated guide rods 20 are provided, each fixed to the rear support 14 by a fastening nut **20*a* and each extending through and supporting a pair of ring members, indicated as inner ring 21 and outer ring 22 forming a ring assembly at the discharge opening 19 for each respective stack of cups. The ends of the rods 20 opposite the fastening nuts 20*a*, as shown in FIG. 2, are bent at right angles against the front face of the front support member 13 of the inner supporting framework. The support rods 20, which are in triangle relationship symmetrically spaced about and concentric with the axis of the stack of cups, as shown in FIGS. 3 and 4, form guides for the cup pusher member 23 and restrain the pusher spring 24 within the confines of the three associated guide rods 20. The cup pusher member 23 in the illustrated embodiment has a truncated conical formation shaped to bear inwardly against the lip portions 17*a*** of the rearmost cup in the associated stack of cups for a wide variety of cup sizes.

Figure 6:
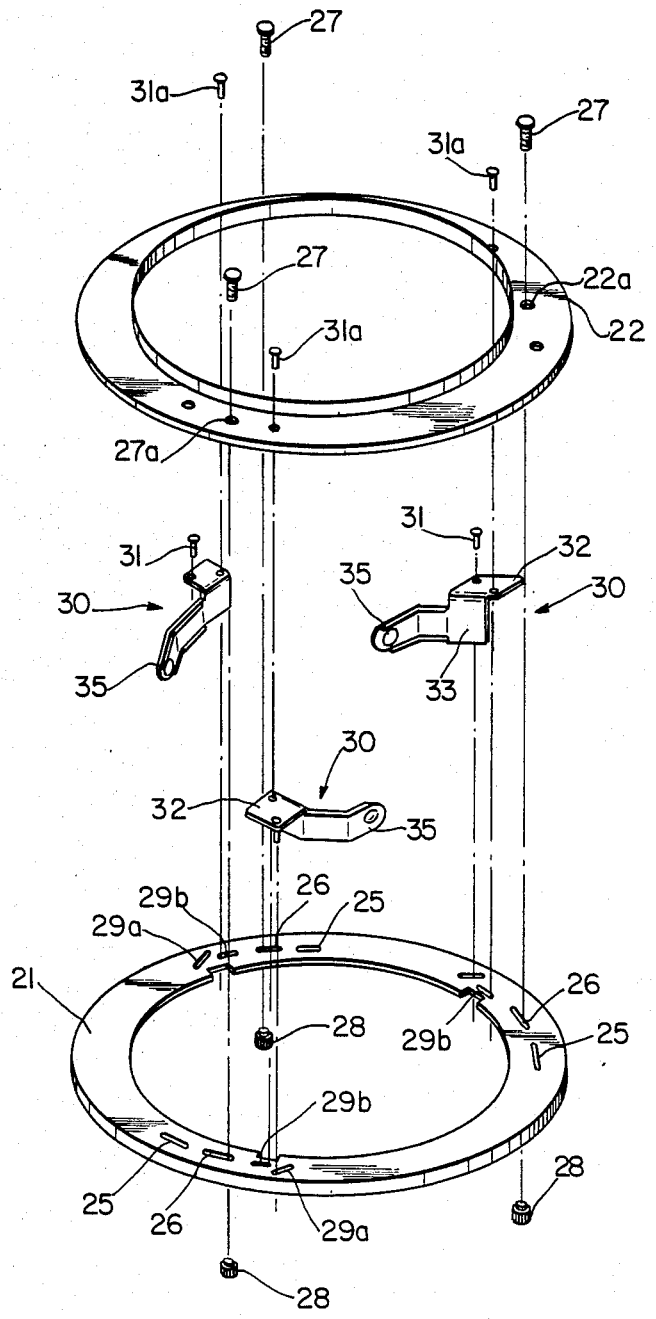
FIG. 6 is an exploded perspective view of the collar assembly components.

The inner ring 21, as is shown in FIGS. 3, 4 and 6, is provided with a first set of three circumferentially elongated slots 25 receiving the guide rods 20 and permitting relative circumferentially movement of the inner ring 21, and additionally includes a second set of three circumferentially elongated slots 26 receiving therethrough the stem or shank of threaded studs 27 installed through accommodating openings in the front support panel 13 and holes **22*a* in the outer ring 22, having a knurled knob 28 threaded on the stud 27 and bearing against the rearwardly facing surface of the inner ring 21 of the collar assembly. Additionally, pairs of slots 29*a*, 29*b* are provided in the inner ring 21 associated with a respective one of the three retaining fingers 30, receiving pins 31, 31*a* projecting from or through the base flange 32 of the associated retaining finger 30. The pins 31***a* form pivots for the fingers 30 while pins 31 extend from the flange 32 of the associated retaining finger 30 and the angular disposition of the slots 29 *a*, 29*b* are such as to cause the retaining fingers 30 to move from the retracted, maximum cup diameter position of FIG. 3 to the projected minimum cup diameter position of FIG. 4 upon rotation of the inner ring 21 relative to the outer ring 22. This relative rotation of the inner ring 21 is effected while the knobs 28 associated with the studs 27 are loosened and then retightened to grip and hold the ring members 21 and 22 in their newly adjusted relative circumferential positions disposing the retaining fingers 30 at the proper position for the cup size.

Alternatively, the outer ring 22 can be dispensed with, and instead the front panel 13 can be provided with the holes 22*a* for the threaded studs 27 and for the pins 31, 31*a*, coactive with the inner ring 21 and fingers 30 in the same manner as the ring 22.

Figure 7:
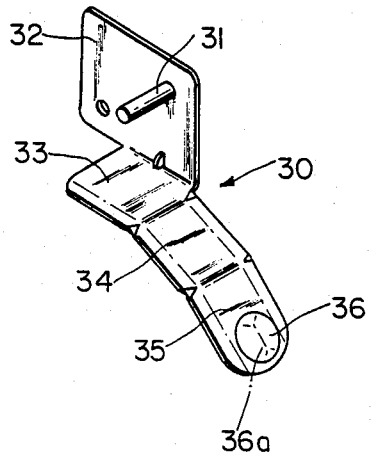
FIG. 7 is a perspective view, to enlarge scale, of one of the retaining fingers.
Figure 8:
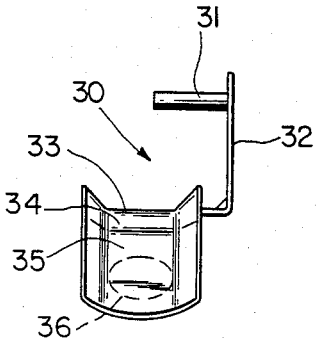
FIG. 8 is an end elevational view of the retaining Figure, viewed from the right of FIG. 7.
Figure 9:
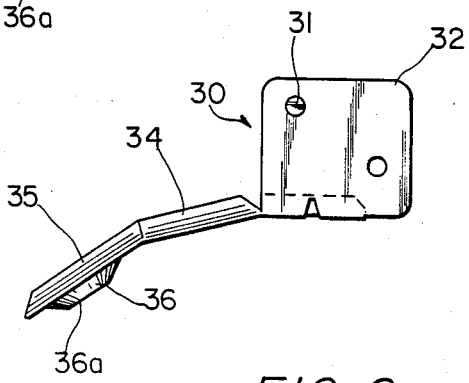
FIG. 9 is a side elevational view of one of the retaining fingers, viewed form the right of FIG. 8.
Figure 5:
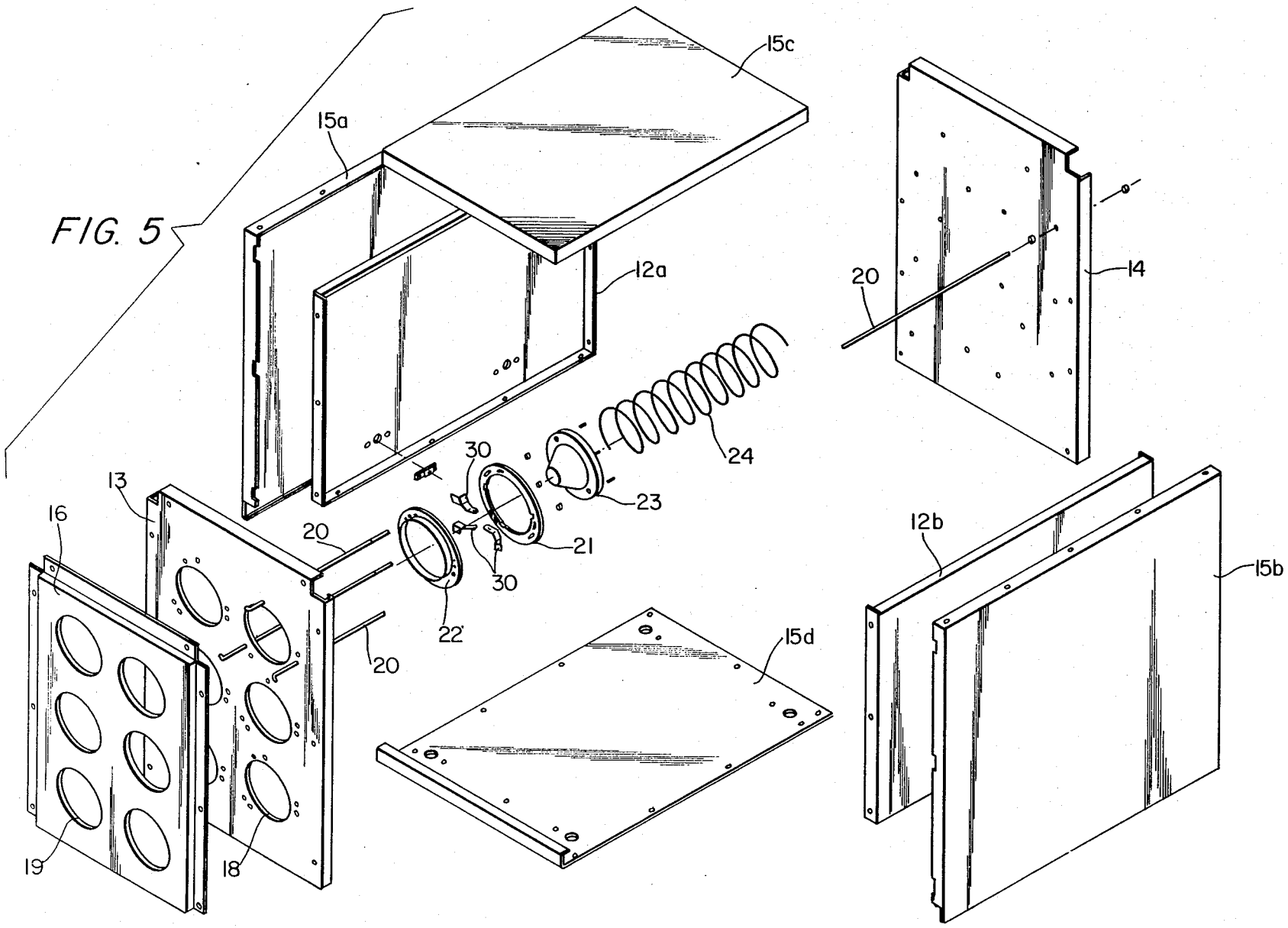
FIG. 5 is an exploded perspective view of the cup dispenser assembly.

The retaining finger 30, as best shown in FIGS. 7, 8 and 9, are formed from a single sheet metal stamping, and include the base flange member 32, in the form of rectangular panel, having a right angle panel protruding perpendicularly therefrom, indicated at 33, from which extends an angular elongated finger formation including a first intermediate portion 34 bent at an angle of about 15 degrees from the plane of the portion 33, and a second end portion 35 bent at an angle of about 20 degrees to the plane of the intermediate portion 34. End portion 35 has a distorted button formation 36 near the free end thereof which has a straight ridge or crest portion 36*a* designed to be interposed between the lip portions 17*a* of successive cups 17, as is shown in FIG. 2, so as to free the outermost cup to be manually withdrawn form the stack through the discharge opening 19 while retaining the remaining cups in stacked array under slight compression between the button portions 36 of the three retaining fingers and the pusher member 23. The desired, length of polyethylene tubing, as indicated at 38 maybe provided surrounding the portions of the rods 20 in the region adjoining the inner ring member 21, to prevent pusher 23 from traveling too far into the opening and interfering with the minimum adjustment range of the opening in the adjustment process.

We claim:

1. A cup dispenser for dispensing a stacked array of cups comprising a housing for enclosing a plurality of cups arranged in a stack along an axis, the housing including a front wall member perpendicular to said axis having a discharge opening through which a bottom cup in the stack extends to be grasped and withdrawn through the discharge opening, a plurality of at least three parallel rods extending inwardly of the housing from said wall member parallel to said axis disposed in surrounding relation to the stack of cups, a pusher guided by said rods for engaging the stack of cups at the end of the stack opposite said discharge opening having associated spring means for urging the stack of cups toward the discharge opening, and an adjustable ring assembly inwardly adjacent said discharge opening for releasably restraining cups of different size, the ring assembly comprising a first ring having a plurality of apertures therein and pivot members extending therefrom and a second ring rotatably supported relative to the first ring having a plurality of slots therein, and a plurality of finger members each having a mounting end portion pivoted about one of said pivot members and provided with a pin member extending through a selected slot of said second ring and having holding end portions t an end of each finger member opposite the mounting end portion provided with holding formations for engaging the rim of the lowermost cup in said stack, and said selected slots extending in such direction that rotation of said second ring causes relative movement of the pins and the slots through which they extend effecting caming movement of the holding end portions of the finger members toward and away from said axis, and manually operable means for releasably fastening the rings against movement relative to each other at positions to which they are circumferentially relatively adjusted.

2. A cup dispenser as defined in claim 1, wherein said manually operable means comprises retaining nut and stud members extending through apertures in said first ring and slots in said second ring accommodating a selected range of relative circumferential movement of said rings, said nut having an abutment surface for clamping said second ring against movement from positions to which it is adjusted.

3. A cup dispenser as defined in claim 1, wherein said first ring has circular openings receiving said rods and said second ring has circumferentially elongated slots for receiving said rods accommodating relative rotation of said second ring relative to the first ring through a range of circumferential positions.

4. A cup dispenser as defined in claim 2, wherein said first ring has circular openings receiving said rods and said second ring has circumferentially elongated slots for receiving said rods accommodating relative rotation of said second ring member relative to the first ring through a range of circumferential positions.

5. A cup dispenser as defined in claim 1, wherein said first ring has circular openings receiving said rods and studs and said second ring has circumferentially elongated slots for receiving said rods and studs accommodating relative rotation of said second ring relative to the first ring through a range of circumferential positions.

6. A cup dispenser as defined in claim 2, wherein said first ring has circular openings receiving said rods and studs and said second ring has circumferentially elongated slots for receiving said rods and studs accommodating relative rotation of said second ring relative to the first ring through a range of circumferential positions.

7. A cup dispenser as defined in claim 1, wherein said pivot members each comprise a pin extending from said first ring through said mounting end portion and through a circumferentially elongated slot in said second ring and wherein a second pin extends through a slot in said second ring inclined at an angle to the direction in which the adjacent slots therein are elongated to effect said caming movement of the finger members toward and away from said axis through action of the inclined slots on said second pin members extending therethrough.

8. A cup dispenser as defined in claim 2, wherein said pivot members each comprise a pin extending from said first ring through said mounting end portion and through a circumferentially elongated slot in said second ring and wherein a second pin extends through a slot in said second ring inclined at an angle to the direction in which the adjacent slots therein are elongated to effect said caming movement of the finger members toward and away from said axis through action of the inclined slots on said second pin members extending therethrough.

9. A cup dispenser as defined in claim 3, wherein said pivot members each comprise a pin extending from said first ring through said mounting end portion and through a circumferentially elongated slot in said second ring and wherein a second pin extends through a slot in said second ring inclined at an angle to the direction in which the adjacent slots therein are elongated to effect said caming movement of the finger members toward and away from said axis through action of the inclined slots on said second pin members extending therethrough.

10. A cup dispenser as defined in claim 4, wherein said pivot members each comprise a pin extending from said first ring through said mounting end portion and through a circumferentially elongated slot in said second ring and wherein a second pin extends through a slot in said second ring inclined at an angle to the direction in which the adjacent slots therein are elongated to effect said caming movement of the finger members toward and away from said axis through action of the inclined slots on said second pin members extending therethrough.

11. A cup dispenser as defined in claim 5, wherein said pivot members each comprise a pin extending from said first ring through said mounting end portion and through a circumferentially elongated slot in said second ring and wherein a second pin extends through a slot in said second ring inclined at an angle to the direction in which the adjacent slots therein are elongated to effect said caming movement of the finger members toward and away from said axis through action of the inclined slots on said second pin members extending therethrough.

12. A cup dispenser as defined in claim 6, wherein said pivot members each comprise a pin extending from said first ring through said mounting end portion and through a circumferentially elongated slot in said second ring and wherein a second pin extends through a slot in said second ring inclined at an angle to the direction in which the adjacent slots therein are elongated to effect said caming movement of the finger members toward and away from said axis through action of the inclined slots on said second pin members extending therethrough.

13. A cup dispenser for dispensing a stacked array of cups comprising a housing for enclosing a plurality of cups arranged in a stack along an axis, the housing including a front wall member perpendicular to said axis having a discharge opening through which a bottom cup in the stack extends to be grasped and withdrawn through the discharge opening, a plurality of at least three parallel rods extending inwardly of the housing from said wall member parallel to said axis disposed in surrounding relation to the stack of cups, a pusher guided by said rods for engaging the stack of cups at the end of the stack opposite said discharge opening having associated spring means for urging the stack of cups toward the discharge opening, and an adjustable ring assembly inwardly adjacent said discharge opening for releasably restraining cups of different size, the ring assembly comprising a ring member having a plurality of slots therein coactive with and rotatably supported relative to a border portion of said front wall member bounding said discharge opening, and a plurality of finger members each having a mounting end portion pivoted about a pin extending from said a border portion and provided with a pin extending through selected slots of said ring member and having holding end portions at an end of each finger member opposite the mounting end portion provided with holding formations for engaging the rim of the lowermost cup in said stack, and said selected slots extending in such direction that rotation of said ring member causes relative movement of the pins and slots through which they extend effecting caming movement of the holding end portions of the finger members toward and away from said axis, and manually operable means for releasably fastening the ring against movement relative to the associated border portion at positions to which it is circumferentially relatively adjusted.

14. A cup dispenser as defined in claim 13, wherein said manually operable means comprises retaining nut and stud members extending through apertures in said border portion and slots in said ring member accommodating a selected range of relative circumferential movement of said ring member, said nut having an abutment surface for clamping said ring member against movement from positions to which it is adjusted.

15. A cup dispenser as defined in claim 13, wherein said pin extending from said border portion passes through a hole in said mounting end portion and through a circumferential elongated slot in said ring member and wherein a second pin member extends from said mounting end portion through a slot in said ring member inclined at an angle to the direction in which the adjacent slots therein are elongated to effect said caming movement of the finger members toward and away from said axis through action of the inclined slots on said second pin members extending therethrough.

16. A cup dispenser as defined in claim 14, wherein said pin extending from said border portion passes through a hole in said mounting end portion and through a circumferential elongated slot in said ring member and wherein a second pin member extends from said mounting end portion through a slot in said ring member inclined at an angle to the direction in which the adjacent slots therein are elongated to effect said caming movement of the finger members toward and away from said axis through action of the inclined slots on said second pin members extending therethrough.

* * * * *